US005593755A

United States Patent [19]

Fuss

[11] Patent Number: 5,593,755

[45] Date of Patent: Jan. 14, 1997

[54] ACCORDION-FOLDED PAPER SHEET PACKING MATERIAL AND METHOD

[75] Inventor: Gunter G. Fuss, San Mateo, Calif.

[73] Assignee: Free-Flow Packaging Corporation, Redwood City, Calif.

[21] Appl. No.: 399,916

[22] Filed: Mar. 7, 1995

[51] Int. Cl.[6] ..... B32B 3/10; B32B 31/00; B31B 1/26

[52] U.S. Cl. ..... 428/134; 428/135; 428/136; 428/138; 428/155; 428/179; 428/181; 428/182; 493/397; 493/405; 493/967; 156/204; 156/207; 156/223; 156/277; 156/250; 156/257

[58] Field of Search ..... 428/124, 134, 428/136, 155, 179, 182, 181, 184, 537.5, 135, 137, 138; 493/967, 405, 397; 53/117; 156/204, 205, 207, 223, 227, 250, 257

[56] References Cited

U.S. PATENT DOCUMENTS

| | | | |
|---|---|---|---|
| 2,503,874 | 4/1950 | Ives | 428/182 |
| 3,434,400 | 3/1969 | Hochfeld | 94/84 |
| 4,247,289 | 1/1981 | McCabe | 493/386 |
| 4,617,122 | 10/1986 | Kruse et al. | 210/493.3 |
| 4,931,342 | 6/1990 | Tolbert et al. | 428/181 |

FOREIGN PATENT DOCUMENTS

| | | |
|---|---|---|
| 9106694 | 5/1991 | European Pat. Off. . |
| 9000586 | 8/1990 | Germany . |
| 9200380 | 3/1992 | Netherlands . |

*Primary Examiner*—Donald Loney
*Attorney, Agent, or Firm*—Flehr, Hohbach, Test, Albritton & Herbert

[57] ABSTRACT

Packing material and method in which a sheet of paper stock is folded in opposite directions along alternate parallel lines to form a series of ridges and valleys, cuts are made in the stock at intervals spaced along the ridges, and sections of the stock adjacent to the cuts are folded in a reverse direction along the fold lines at the ridges to form downwardly extending pleats beneath the ridges. The material can be crumpled for use as a dunnage material or wrapped about an item to be protected. In one disclosed embodiment, the material can be compressed for shipping and storage and expanded for use. In another, which is particularly suitable for use as a protective wrap, the folded stock is affixed to a backing sheet.

13 Claims, 7 Drawing Sheets

ACCORDION-FOLDED PAPER SHEET PACKING MATERIAL AND METHOD

BACKGROUND OF THE INVENTION

1. Field of the Invention

This invention pertains generally to packing materials and, more particularly, to a material which can be used either as a dunnage material or as a protective wrap for fragile items.

2. Related Art

Materials heretofore used for dunnage have included expanded plastic foams, starch materials, excelsior and shredded paper. Such materials are generally effective in preventing damage to fragile items which are packed in them, but they tend to be messy and can also be difficult to dispose of. In addition, although they are generally light in weight, such materials are relatively bulky and require substantial space for shipment and storage.

Materials heretofore utilized as protective wraps for fragile items have included corrugated cardboard materials, bubble pack materials and flexible sheets of expanded plastic foams. Such materials also have limitations and disadvantages in that some can only be wrapped in one direction and some are difficult to dispose of.

OBJECTS AND SUMMARY OF THE INVENTION

It is in general an object of the invention to provide a new and improved packing material and method of manufacturing the same.

Another object of the invention is to provide a packing material and method of the above character wherein the material can be used either as a dunnage material or as a protective wrap.

These and other objects are achieved in accordance with the invention by providing a packing material and method in which a sheet of paper stock is folded in opposite directions along alternate parallel lines to form a series of ridges and valleys, cuts are made in the stock at intervals spaced along the ridges, and sections of the stock adjacent to the cuts are folded in a reverse direction along the fold lines at the ridges to form downwardly extending pleats beneath the ridges. The material can be crumpled for use as a dunnage material or wrapped about an item to be protected. In one disclosed embodiment, the material can be compressed for shipping and storage and expanded for use. In another, which is particularly suitable for use as a protective wrap, the folded stock is affixed to a backing sheet.

DETAILED DESCRIPTION

Figure 1:
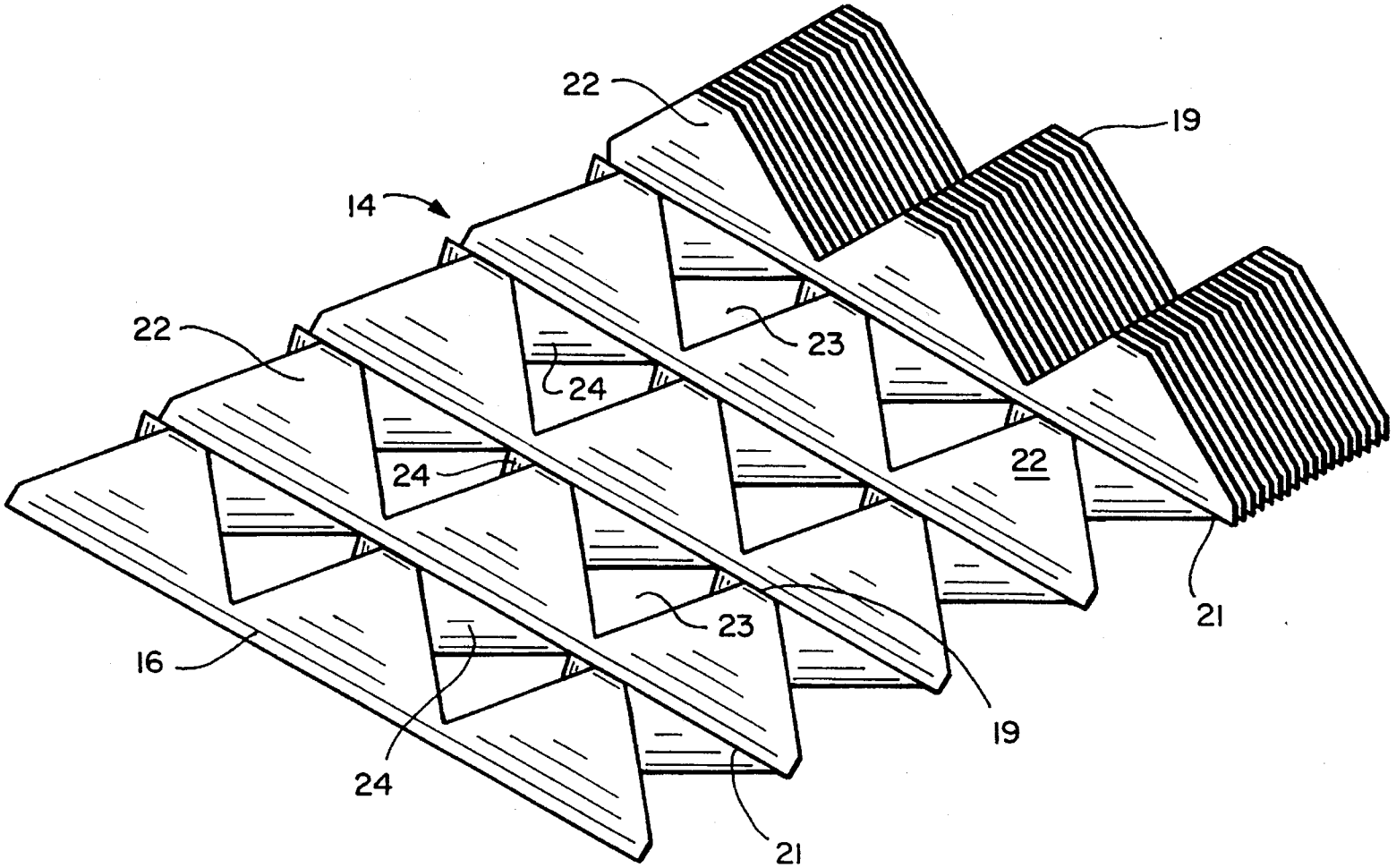
FIG. 1 is fragmentary isometric view of one embodiment of a packing material according to the invention.
Figure 2:
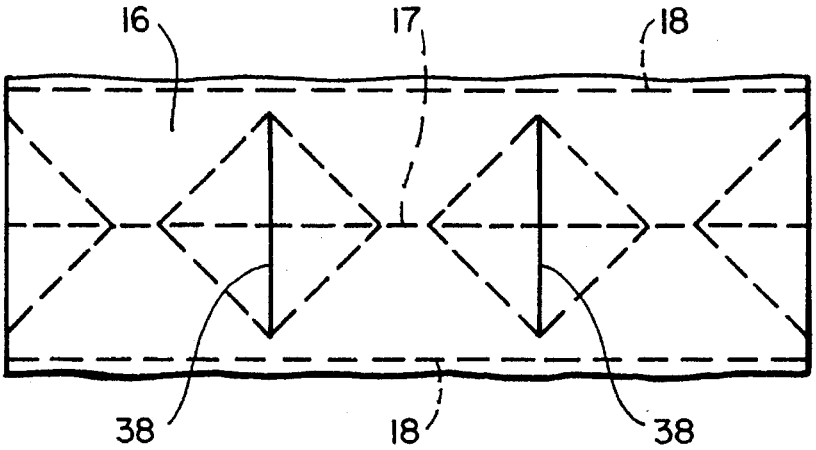
FIG. 2 is a fragmentary top plan view of the paper stock from which the embodiment of FIG. 1 is made.
Figure 3:
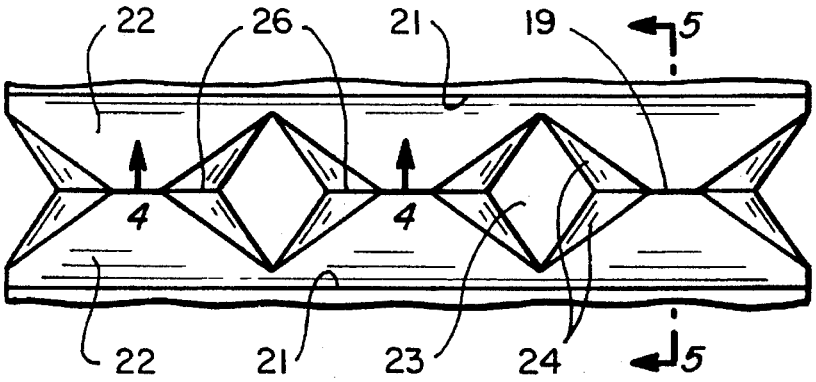
FIG. 3 is a fragmentary top plan view of the embodiment of FIG. 1.
Figure 4:
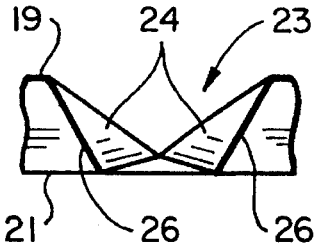
FIG. 4 is a cross-sectional view taken along line 4—4 in FIG. 3.
Figure 5:
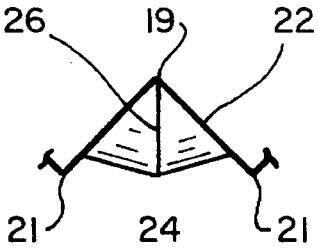
FIG. 5 is a cross-sectional view taken along line 5—5 in FIG. 3.

As illustrated in FIG. 1, the packing material 14 is formed from a sheet of paper stock 16 which can be of any desired thickness and weight, e.g. 40 to 100 pound Kraft paper. The paper is folded in fanfold or accordion fashion in opposite directions along alternate parallel lines 17, 18 to form a series of ridges 19 and valleys 21, with generally planar panels 22 between them. Openings 23 are formed in the stock at intervals spaced along the ridges, and sections 24 of the stock at the ends of the openings are folded downwardly in a reverse direction along the fold lines at the ridges to form downwardly extending pleats 26 beneath the ridges.

The dimensions of the sheet and the number of openings can be chosen as desired. In one presently preferred embodiment, the sheet has a width of 12 inches, the panels are ¾ inch high, and seven openings are spaced on 1½ centers along each ridge.

In use, the material is opened out or expanded, with panels 22 inclined at an angle on the order of 45°. For shipment and storage, the material is compacted or compressed, with the panels vertical and adjacent to each other. In FIG. 1, the material is shown in the expanded state toward the left side of the figure and in the compressed state toward the right. In the compressed state, the material occupies substantially less space than it does in the expanded state. With a 100 weight paper and panels having a height on the order of ¾ inch, for example, a quantity of the material which is one inch thick in the compressed state has a length on the order of 20 inches in the expanded state. This 20:1 compression results in a substantial space saving for shipment and storage. With a sheet which is 12 inches in width, approximately 320 lineal feet of the expanded material can be stored in a volume of only one cubic foot when compressed. With a 40 pound paper, the compression is on the order of 30:1, and approximately 480 lineal feet of 12 inch wide material can be stored in a cubic foot.

Figure 6:
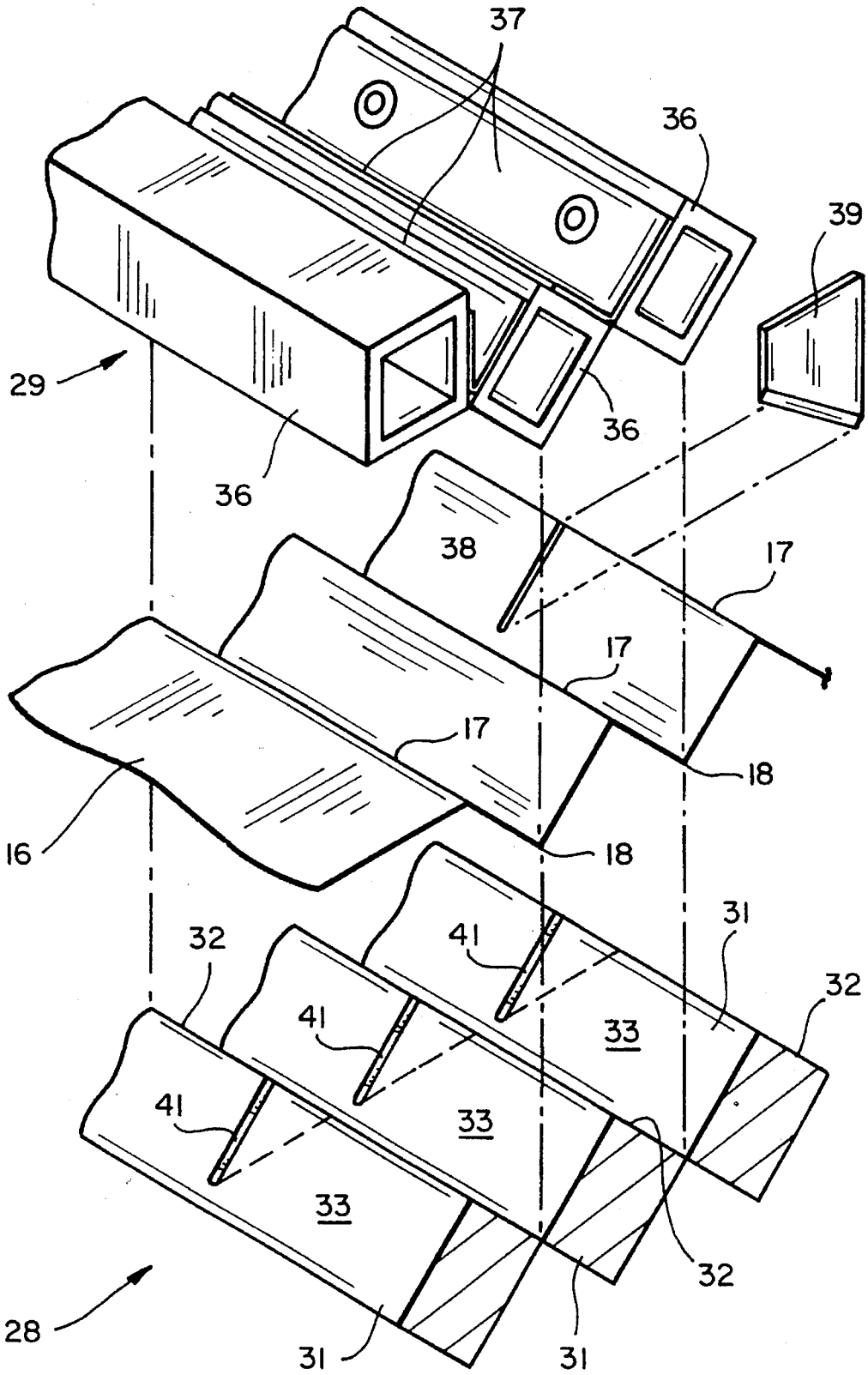
FIG. 6 is an exploded isometric view, somewhat schematic, illustrating the manufacture of a packing material in accordance with the invention.
Figure 7:
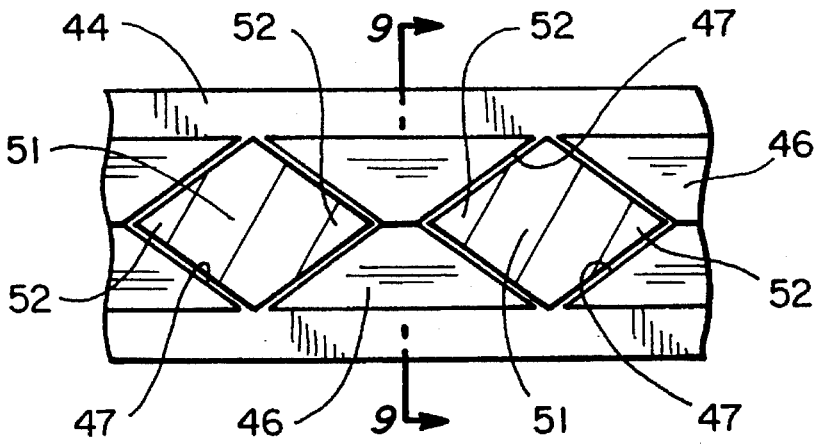
FIG. 7 is a fragmentary horizontal sectional view of one embodiment of a set of die fixtures employed in the manufacture of the packing material.
Figure 8:
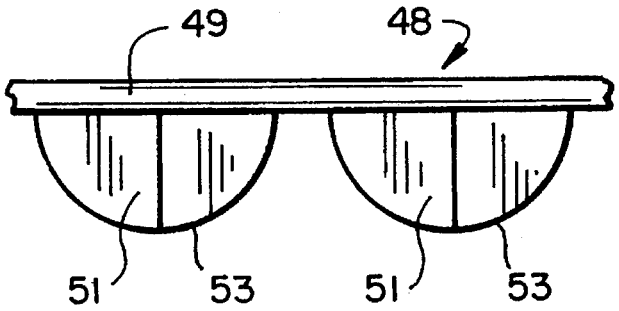
FIG. 8 is a front elevational view of one of the die fixtures in the embodiment of FIG. 7.
Figure 9:
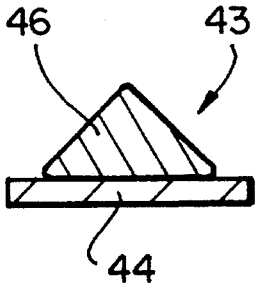
FIG. 9 is a cross-sectional view taken along line 9—9 in FIG. 7.

The material is made by folding the sheet in accordion-like fashion along fold lines 17, 18. As illustrated in FIG. 6, this can be done by pressing the sheet between a pair of corrugating forms 28, 29. In the embodiment illustrated, the lower form 28 is stationary and consists of a plurality of solid bars 31 of square cross-section positioned corner-to-corner, with the surfaces 32, 33 of adjacent bars perpendicular to each other. The upper form consists of a plurality of tubular bars 36 of square cross-section which are connected together by hinges 37 on the upper or back surfaces of the bars. With the flexible connections between the bars, the upper form can, in effect, be rolled onto the lower form from one end to the other, with one end of the sheet remaining free as the two forms come together. That enables the sheet to conform to the contour of the lower form much more readily than it would if both forms were rigid and pressure were applied over the entire length of the forms at once.

While the corrugating forms of FIG. 6 have been used successfully in the development of the invention, it is anticipated that commercially available pleating machines may be utilized to fanfold the paper stock in larger quantities.

Once the folds have been made, cuts 38 are made in the sheet at spaced intervals along the ridge lines. These cuts are perpendicular to the ridge lines and, in the embodiment illustrated, are made by a knife blade 39 which passes through slots 41 in the upper corners of bars 31. The cuts are located at the centers of the openings and are spaced apart by the same distance as the openings.

After the cuts are made, the sheet is removed from form 28 and placed on a fixture 43 where the pleats 26 are formed. This fixture has a base plate 44 and a plurality of stationary dies 46 mounted on the plate at intervals corresponding to the distance between the cuts. These dies have a generally triangular profile in cross-section, with the apexes of the triangles fitting up into the area beneath the ridge line of the sheet. V-shaped notches 47 are formed in the ends of the dies, with the notches in the confronting ends of adjacent dies being spaced apart by a distance corresponding to the length of the openings to be formed in the sheet.

A second die fixture 48 is movable in a vertical direction relative to the stationary fixture, and has a rigid bar 49 with a plurality of downwardly facing dies 51 which cooperate with the notches in dies 46 to form the pleats. Dies 51 have a diamond-shaped profile in plan view, with end portions or corners 52 of those dies being received in the notches of the stationary dies. The lower edges 53 of dies 51 are rounded, and those edges engage the upper surface of the sheet along the ridge line between the lower dies and fold the portions of the sheet adjacent to the cuts downwardly in reverse direction along the ridge line to form the pleats as the upper and lower dies come together.

Once the pleats are formed, the material is removed from the fixture and compressed to bring the panels tightly together. With the material in the compressed state, it is wet and then dried in order to impart a memory to it. That memory causes the material to tend to remain in the compressed state until it is ready for use. The drying process can be expedited by suitable heating techniques such as exposing the material to hot air or infrared lamps.

The compressed material can be packed into boxes or formed into rolls for shipment and storage. A continuous length of the material can be fed into the box in serpentine fashion and stacked in layers within the box. With sheets having a width of 12 inches and panels which are ¾ inch high might, for example, sixteen layers which are 12 inches in length can be packed in a carton which is twelve inches square and one foot high. With a compression of 30:1, the sixteen layers will provide approximately 480 feet of packing material when expanded. Alternatively, the compressed material can be cut into individual sections which are stacked in the box, but a single continuous length will probably be preferred for most applications.

Figure 10:
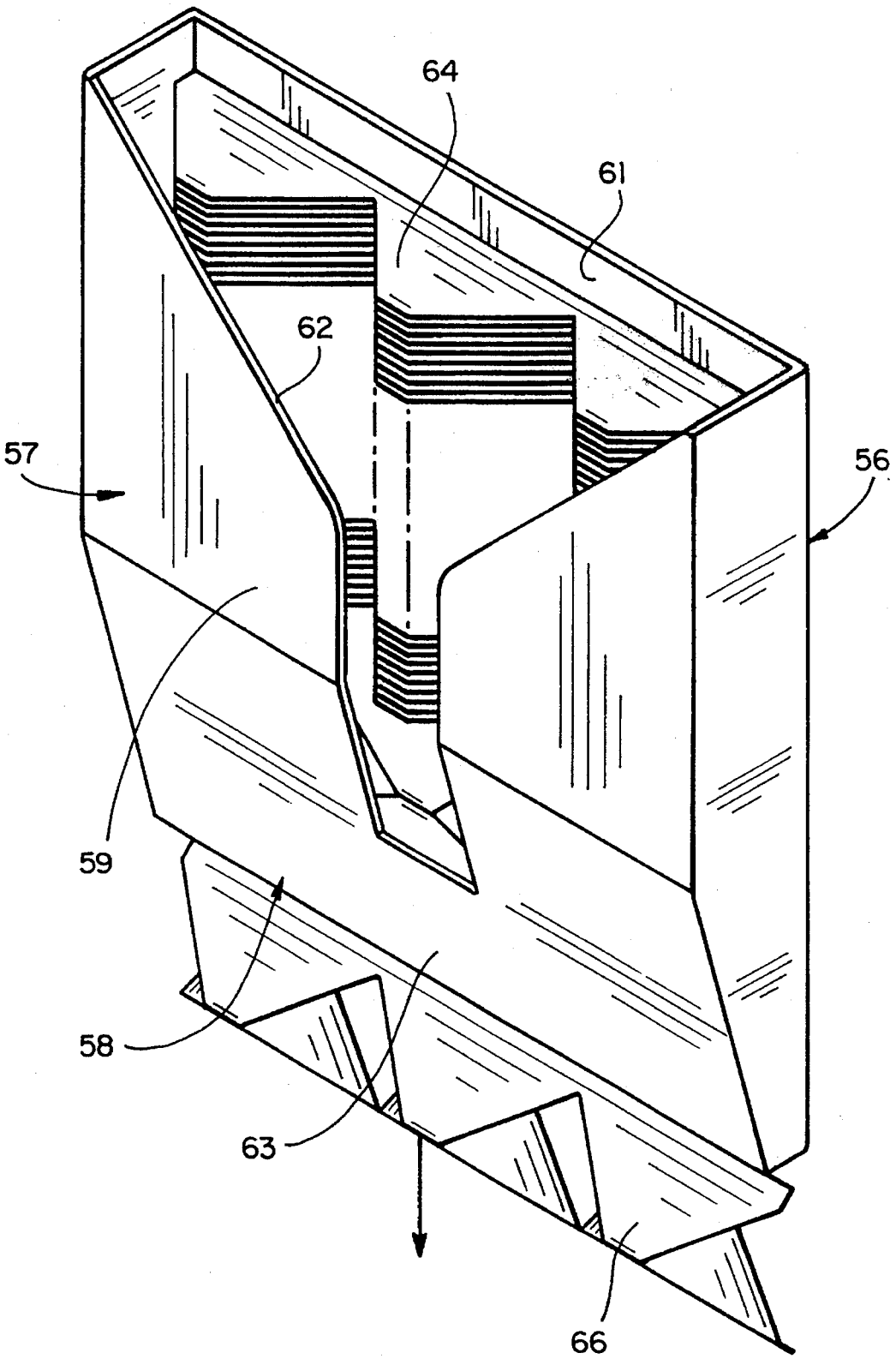
FIG. 10 is an isometric view of one embodiment of a dispenser with the packing material of FIG. 1.

One method of dispensing the material for use is illustrated in FIG. 10, where the compressed material is placed in a dispenser 56 which has a generally rectangular upper section 57 and a tapered lower section or throat 58. The upper section has generally parallel front and rear walls 59, 61, with a generally V-shaped opening 62 in the front wall for access to the material. The lower section 63 of the front wall is inclined downwardly and inwardly to form the tapered section or throat.

The compressed material 64 is stacked in the upper section of the dispenser, with the lowermost portion 66 of the sheet being fed out through the opening at the bottom of the throat where it can be readily grasped and drawn from the dispenser by a person using the material. As the material is withdrawn, tapered throat resists the movement of the material and causes the material to become expanded as it leaves the dispenser. The degree of expansion and, hence, the thickness of the material are dependent upon the width of the opening, with a smaller opening providing more resistance with greater lengthwise expansion and less thickness.

The expanded mate, rial can be crumpled up and packed about an object in a container to cushion and protect the object in much the same way that a loose fill dunnage material would protect it. The expanded material can also be wrapped about an object in much the same manner as a corrugated or bubble packing material. Because of the openings along the ridge lines, the material has a two dimensional flexibility which enables it to follow the contours of an object substantially better than a corrugated material. For greater flow when used as a dunnage material, the folded sheet can be cut into narrower webs, e.g. 3 inch strips or 6 inch strips, if desired.

Figure 11:
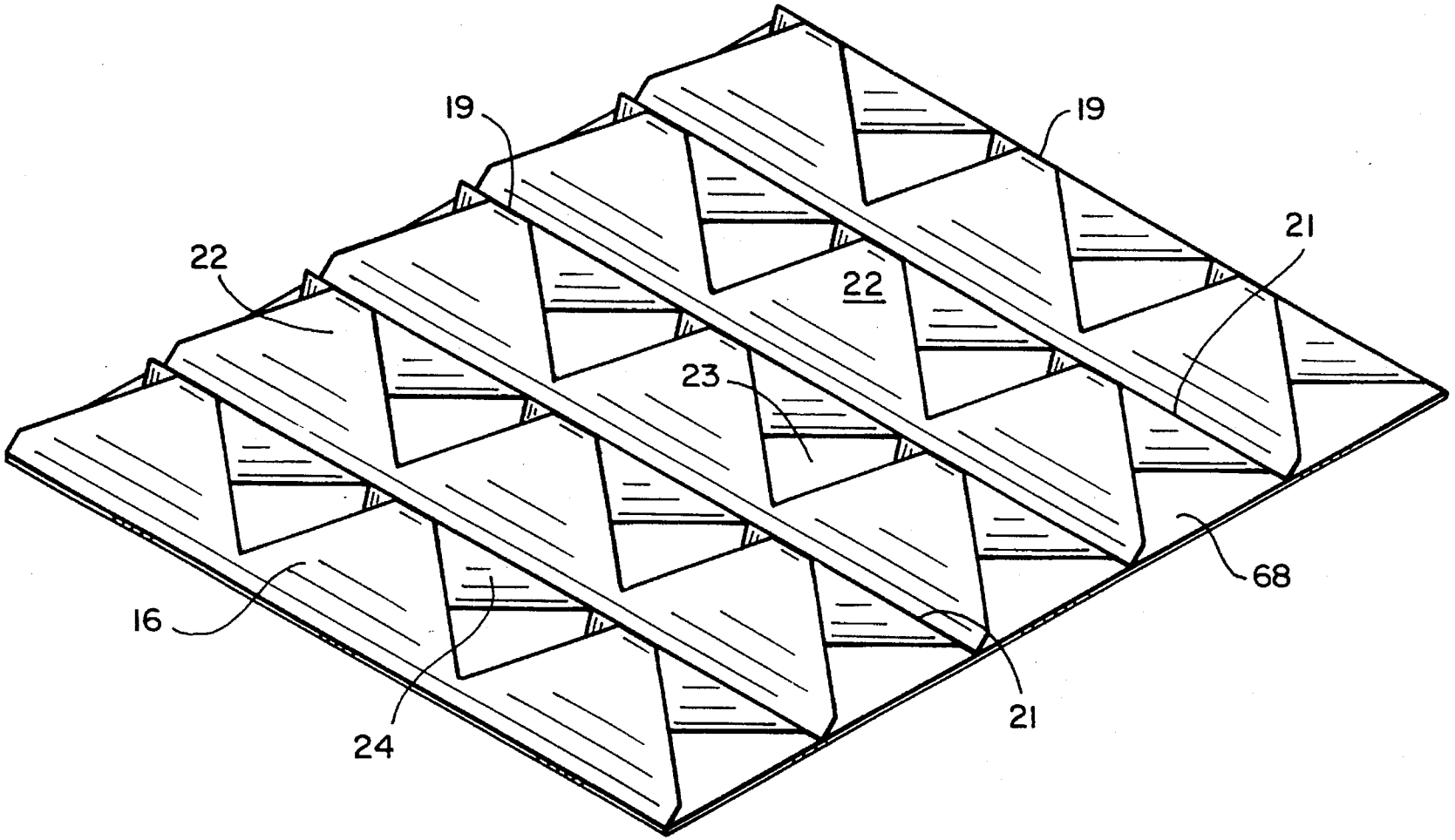
FIG. 11 is fragmentary isometric view of another embodiment of a packing material according to the invention.

The embodiment of the packing material illustrated in FIG. 11 is generally similar to the material of FIG. 1, and like reference numerals designate corresponding elements in the two embodiments. In the embodiment of FIG. 11, however, a backing sheet 68 is affixed to the under or back side of the expanded sheet, with valleys spaced apart along the backing sheet. The backing sheet can be of the same type of paper stock as the folded sheet, although it is preferably a lighter weight stock for greater flexibility, easier handling and greater economy. The backing sheet is laminated to the folded sheet after the pleats have been formed in the folded sheet, and the two sheets are secured together by a suitable adhesive.

With the laminated material, the pitch and thickness of the material are fixed, and the material has more substance than the unbacked material. It also handles somewhat better and has less tendency to flatten in use than the unbacked material. Because of the openings and the pleats in the folded sheet, the laminated material has a greater flexibility perpendicular to the fold lines than conventional Corrugated materials which are relatively rigid in that direction.

Since the laminated material cannot be compressed, it is most easily shipped and stored in rolls. The laminated material does not crumple as easily as the unbacked material, and is more suitable for use as a wrap for fragile items.

Figure 12:
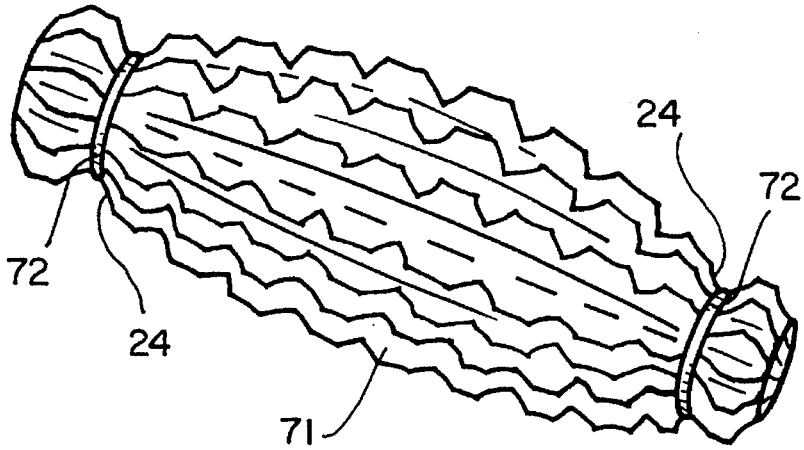
FIG. 12 is an isometric view of one embodiment of an object wrapped with a protective material in accordance with the invention.

One significant advantage of both the unbacked material and the laminated material is the ease with which the material can be wrapped about an object and secured. In FIG. 12, a length 71 of the material is wrapped about an object (not shown) and secured with rubber bands 72 or other suitable fasteners at the ends of the object. Aligned rows of openings 24 in the rolled material form grooves in which the bands or ties are received, and the bands or ties tend to remain securely in place.

Figure 13:
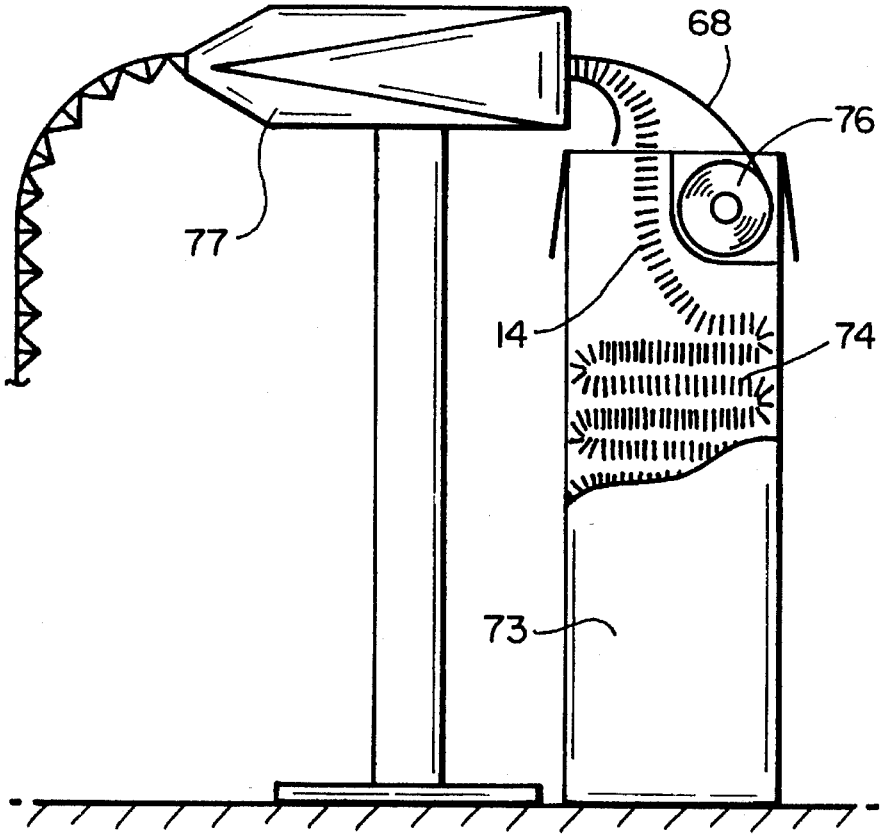
FIG. 13 is an isometric of view of an embodiment in which a packing material according to the invention is assembled at the point of use.

As illustrated in FIG. 13, the two sheets which make up the laminated material can also be shipped and stored separately and assembled at the point of use, with a significant reduction in the amount of space required for the material. In this embodiment, the two sheets are shipped in a single carton 73, with the folded sheet 14 being packed in its compressed state in serpentined layers 74 in the lower portion of the carton and the backing sheet 68 being on a roll 76 in the upper portion of the canon. The two sheets are fed from the carton to a laminating machine 77 which expands the folded sheet and laminates the two sheets together.

The invention has a number of important features and advantages. The material can be used either as a dunnage material or as a protective wrap for fragile items. The creases and reverse creases impart body and stiffness to the material, which enhances its ability to absorb shock and protect the object. In all but one embodiment, the material is highly compressible, which significantly reduces the amount of space required for shipment and storage of the material. Being made of paper stock, it is both biodegradable and recyclable. It is dust-free and avoids the messiness of other materials such as excelsior and shredded paper.

It is apparent from the foregoing that a new and improved packing material and method have been provided. While only certain presently preferred embodiments have been described in detail, as will be apparent to those familiar with the art, certain changes and modifications can be made without departing from the scope of the invention as defined by the following claims.

I claim:

1. A packing material of folded paper stock, comprising a plurality of generally planar panels joined together in fan-fold fashion along spaced apart parallel fold lines to form a series of ridges and valleys, openings in the stock at intervals spaced along the ridges, and downwardly extending pleats beneath the ridges comprising sections of the stock folded in a reverse direction along the fold lines adjacent to the openings.

2. The packing material of claim 1 wherein the material is compressed with adjacent ones of the panels stacked against each other.

3. The packing material of claim 1 including a backing sheet affixed to the stock, with the valleys spaced apart along the backing sheet.

4. In a method of manufacturing a packing material, the steps of: folding a sheet of stock in opposite directions along alternate parallel fold lines to form a series of ridges and valleys, making cuts in the stock at intervals spaced along the ridges, and folding sections of the stock adjacent to the cuts in a reverse direction along the fold lines at the ridges to form downwardly extending pleats beneath the ridges.

5. The method of claim 4 further including the step of compressing the folded stock together along the fold lines to reduce the bulk of the material for shipping and/or storage.

6. The method of claim 5 further including the step of imparting a memory to the folded stock such that the folded stock tends to return toward its compressed state.

7. The method of claim 4 further including the step of affixing the folded stock to a backing sheet, with the fold lines which define the valleys being spaced apart along the backing sheet.

8. The method of claim 4 wherein the cuts are made perpendicular to the fold lines.

9. A packing material made by the steps of: folding a sheet of stock in opposite directions along alternate parallel fold lines to form a series of ridges and valleys, making cuts in the stock at intervals spaced along the ridges, and folding sections of the stock adjacent to the cuts in a reverse direction along the fold lines at the ridges to form downwardly extending pleats beneath the ridges.

10. The packing material of claim 9 wherein the folded stock is compressed together along the fold lines to reduce the bulk of the material for shipping/storage.

11. The packing material of claim 10 wherein a memory is imparted to the folded stock such that the folded stock tends to return toward its compressed state.

12. The packing material of claim 9 wherein the folded stock is affixed to a backing sheet, with the fold lines which define the valleys being spaced apart along the backing sheet.

13. The packing material of claim 9 wherein the cuts are perpendicular to the fold lines.

* * * * *